US008863403B2

(12) United States Patent
Lee et al.

(10) Patent No.: US 8,863,403 B2
(45) Date of Patent: Oct. 21, 2014

(54) MISTING CONTROL METHOD OF CLOTHING DRYER

(75) Inventors: Bo Ram Lee, Yongin-si (KR); Hyun Sook Kim, Suwon-si (KR); Hwang Mook Cho, Hwaseong-si (KR); So Jung Yu, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 494 days.

(21) Appl. No.: 12/926,082

(22) Filed: Oct. 25, 2010

(65) Prior Publication Data

US 2011/0107617 A1 May 12, 2011

(30) Foreign Application Priority Data

Nov. 9, 2009 (KR) ..... 10-2009-0107340

(51) Int. Cl.

| | |
|---|---|
| ***F26B 7/00*** | (2006.01) |
| ***D06F 73/02*** | (2006.01) |
| ***D06F 58/20*** | (2006.01) |
| ***D06F 58/28*** | (2006.01) |

(52) U.S. Cl.

CPC ..... *D06F 58/203* (2013.01); *D06F 73/02* (2013.01); *D06F 58/28* (2013.01); *D06F 58/20* (2013.01)

USPC ..... 34/427; 34/381; 34/443

(58) Field of Classification Search

USPC ..... 34/427

See application file for complete search history.

(56) References Cited

U.S. PATENT DOCUMENTS

| | | | | |
|---|---|---|---|---|
| 8,166,669 | B2 * | 5/2012 | Park et al. | 34/399 |
| 8,250,777 | B2 * | 8/2012 | Kim et al. | 34/595 |
| 2008/0168679 | A1 * | 7/2008 | Son et al. | 34/497 |
| 2009/0249639 | A1 | 10/2009 | Kim et al. | |
| 2010/0050464 | A1 | 3/2010 | Krzelowski et al. | |

FOREIGN PATENT DOCUMENTS

| | | | |
|---|---|---|---|
| CN | 101319458 | | 12/2008 |
| EP | 2000581 | | 12/2008 |
| EP | 2000581 | A1 * | 12/2008 |
| JP | 5-177086 | | 7/1993 |
| JP | 9-38400 | | 2/1997 |
| KR | 10-0774217 | | 11/2007 |
| KR | 10-2008-0059916 | | 7/2008 |

OTHER PUBLICATIONS

Russian Office Action dated Dec. 15, 2011 issued in corresponding Russian Patent Application No. 2010144458/12(064081).

European Search Report, completed Mar. 24, 2011, in corresponding European Application No. EP 10188534 (4 pp.).

Chinese Office Action dated Jan. 28, 2014 from Chinese Patent Application No. 2014012400918020, 6 pages.

* cited by examiner

*Primary Examiner* — Kenneth Rinehart
*Assistant Examiner* — Gajanan M Prabhu
(74) *Attorney, Agent, or Firm* — Staas & Halsey LLP

(57) ABSTRACT

Disclosed herein is a control method of clothing dryer that sprays an appropriate amount of mist based on the amount of clothing and dries the clothing at a fiber rearrangement temperature to remove wrinkles from the clothing. Standard regain of clothing is confirmed, mist is sprayed such that an amount of mist equivalent to approximately twice the standard regain reaches the clothing, and the clothing is dried at the fiber rearrangement temperature, whereby wrinkles are removed from the clothing.

16 Claims, 5 Drawing Sheets

MISTING CONTROL METHOD OF CLOTHING DRYER

CROSS-REFERENCE TO RELATED APPLICATIONS

This application claims the benefit of Korean Patent Application No. 2009-0107340, filed on Nov. 9, 2009 in the Korean Intellectual Property Office, the disclosure of which is incorporated herein by reference.

BACKGROUND

1. Field

Embodiments relate to a control method of a clothing dryer that removes wrinkles from clothing.

2. Description of the Related Art

A clothing dryer is an electric home appliance to dry washed laundry using high-temperature air. Based on an air heating method, the clothing dryer may be classified as an electric-type clothing dryer or a gas-type clothing dryer. The electric-type clothing dryer heats air using electric resistance heat, and the gas-type clothing dryer heats air using heat generated by combustion of gas. Based on another method, the clothing dryer may be classified as a condensation-type clothing dryer or an exhaust-type clothing dryer. In the condensation-type clothing dryer, high-humidity air, heat-exchanged with clothing in a drum, is not discharged out of the clothing dryer but circulates in the clothing dryer. The air is heat-exchanged with external air by a condenser, with the result that humidity in the air is changed into condensed water, which is discharged to the outside. In the exhaust-type clothing dryer, high-humidity air, heat-exchanged with clothing in a drum, is directly discharged out of the clothing dryer.

Meanwhile, the clothing dryer may perform a wrinkle removal course to remove wrinkles from dried clothing, i.e., clothing containing no moisture. During the wrinkle removal course, an appropriate amount of mist or steam may be supplied to the clothing, and the clothing supplied with the mist or the steam may be dried, to remove wrinkles from the clothing.

SUMMARY

Therefore, it is an aspect of at least one embodiment to provide a control method of a clothing dryer to adjust an amount of mist to be sprayed based on clothing to improve wrinkle removal performance.

It is another aspect of at least one embodiment to provide a control method of a clothing dryer to perform an additional cycle in addition to a mist spraying cycle and a drying cycle to improve wrinkle removal performance.

Additional aspects of at least one embodiment will be set forth in part in the description which follows and, in part, will be obvious from the description, or may be learned by practice of the invention.

The foregoing and/or other aspects are achieved by providing a control method of a clothing dryer to spray mist into a drum of the clothing dryer to remove wrinkles from clothing within the drum, the method including detecting an amount of the clothing within the drum, determining twice standard regain per unit weight of the clothing based on at least the detected amount of the clothing, spraying an amount of mist equivalent to approximately twice standard regain per unit weight of the clothing to the clothing and drying the clothing at a fiber rearrangement temperature to remove wrinkles from the clothing.

The standard regain of the clothing may be determined based on a kind of the clothing.

The kind of the clothing may be manually input by a user or automatically detected. When the kind of the clothing is not selected, the kind of the clothing may be set based on a kind of basic fiber of the clothing (for example, cotton).

The spraying the amount of the mist may include calculating the amount of mist to be sprayed based on the detected amount of the clothing and the standard regain of the clothing.

The fiber rearrangement temperature may be between approximately 60 and 70° C.

The control method may further include diffusing the mist to the clothing by intermittently rotating the drum, after spraying the mist to the clothing. Intermittently rotating the drum may include setting an off time to be longer than an on time per operation cycle of the drum and intermittently rotating the drum according to the off time and the on time per operation cycle.

The control method may further include supplying hot air into the drum, such that the mist in the clothing is changed into steam, before drying the clothing. During steaming, the hot air may be supplied such that the temperature in the drum reaches approximately 30 to 40° C.

The control method may further include additionally spraying a second amount of mist into the drum after the amount of mist equivalent to approximately twice standard regain per unit weight of the clothing is sprayed in the drum. The control method may further include measuring a mist spraying time to measure an amount of mist provided to the drum, wherein the second amount of mist additionally sprayed into the drum may be determined to be proportional to the measured amount of the mist.

The foregoing and/or other aspects are achieved by providing a control method of a clothing dryer to spray mist into a drum of the clothing dryer to remove wrinkles from clothing within the drum, the method including detecting an amount of the clothing within the drum, spraying an amount of mist according to the detected amount of the clothing, diffusing the mist to the clothing, and drying the clothing wetted by the mist.

Diffusing the mist to the clothing may include setting an off time to be longer than an on time per operation cycle of the drum and intermittently rotating the drum according to the off time and the on time per operation cycle.

The spraying the amount of mist may include determining a standard regain of the clothing and determining the amount of mist to be sprayed to be equivalent to approximately twice standard regain based on the detected amount of the clothing.

Drying the clothing wetted by the mist may include drying the clothing at a fiber rearrangement temperature. The fiber rearrangement temperature may be between approximately 60 and 70° C.

The control method may further include changing moisture in the clothing into steam before drying the clothing wetted by the mist. Changing moisture in the clothing into steam may include changing the mist in the clothing into steam while maintaining the temperature in the drum at approximately 30 to 40° C.

The control method may further include cooling the clothing by rotating the drum after drying the clothing. The cooling the clothing may further include supplying cold air into the drum The foregoing and/or other aspects are achieved by providing a control method of a clothing dryer to spray mist into a drum of the clothing dryer to remove wrinkles from clothing within the drum, the method including detecting an amount of the clothing within the drum, spraying an amount of mist according to the detected amount of the clothing, intermittently rotating the drum such that the mist is diffused to the clothing, supplying hot air into the drum to change the mist in the clothing into steam, and drying the clothing.

The control method may further include cool the clothing by supplying cold air into the drum after drying the clothing.

The control method may further include determining a kind of the clothing based on one of an automatically detected kind of clothing and an input kind of clothing, and determining the amount of the sprayed mist to be equivalent to twice standard regain based on the detected amount of the clothing and the determined kind of the clothing, and wherein the temperature to dry the clothing may be between approximately 60 and 70° C.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
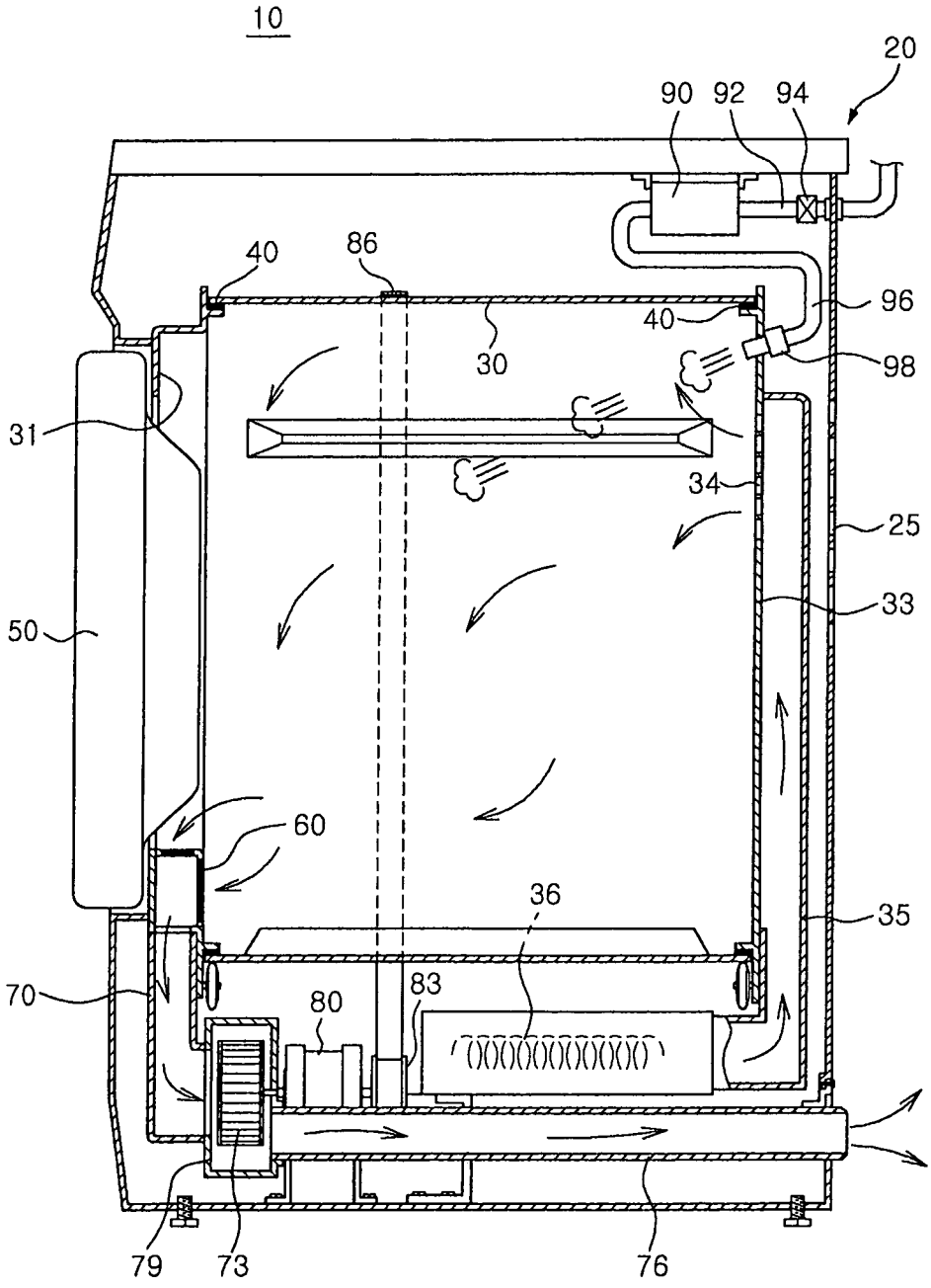
FIG. 1 is a sectional view illustrating a clothing dryer having a mist generator according to at least one embodiment.

Reference will now be made in detail to at least one embodiment, examples of which are illustrated in the accompanying drawings, wherein like reference numerals refer to like elements throughout.

FIG. 1 is a sectional view illustrating a clothing dryer 10 having a mist generator according to at least one embodiment.

As shown in FIG. 1, the clothing dryer 10 includes a housing 20, configured approximately in a hexahedral shape, having through holes 25 prepared at the rear thereof to suction external air, a cylindrical drum 30, provided in the housing 20, open at the front and rear thereof, front and rear brackets 31 and 33 to slidably support inner circumferences of front and rear ends of the drum 30, respectively, and slide pads 40 provided between the drum and the front bracket 31 and between the drum 30 and the rear bracket 33 to accelerate rotational motion of the drum 30.

Above the drum 30 is provided a mist generator 90 to spray mist into the drum 30. The mist generator 90 may generate mist using various well-known kinds of technology, such as a piezoelectric element or an ultrasonic transducer, for example. The mist generator 90 is connected to a mist water supply pipe 92 to supply water from an external water source. The mist water supply pipe 92 includes a mist valve 94 to control the supply of water to the mist generator 90. Also, the mist generator 90 is connected to a mist supply pipe 96 extending to the drum 30 to supply mist to clothing. The mist supply pipe 96 includes a spray nozzle 98 provided at an outlet thereof.

The front bracket 31, provided at the front of the drum 30, is opened at the center thereof such that clothing is able to be put into the drum 30 from a door 50 side. At the lower part of the front bracket 31 is formed an exhaust port 60 to discharge air containing moisture from clothing to the outside.

Below the drum 30 are provided an exhaust duct 70, a blowing fan 73 and an exhaust pipe 76 to discharge air from the exhaust port 60 out of the clothing dryer 10. The exhaust duct 70 guides air discharged from the exhaust port 60 to the lower part of the housing 20. The exhaust duct 70 is connected to the blowing fan 73 to induce the flow of air in the clothing dryer 10. Air blown by the blowing fan 73 is discharged to the outside through the exhaust pipe 76, which has one end connected to a fan casing 79 of the blowing fan 73 and the other end extending to the outside of the housing 20.

Below the drum 30 is provided a drive motor 80 to simultaneously drive the blowing fan 73 and the drum 30. The drive motor 80 has a drive shaft extending in frontward and rearward directions. One side of the drive shaft is connected to the blowing fan 73, and the other side of the drive shaft is connected to a pulley 83 to drive the drum 30. The pulley 83 and the drum 30 are interconnected via a belt 86 such that the drum 30 is rotated according to the driving of the drive motor 80.

At the upper part of the rear bracket 33, provided at the rear of the drum 30, are formed suction holes 34 to suction hot air. At the rear of the rear bracket 33 is provided a suction duct 35 to guide hot air to the suction holes 34. The suction duct 35 extends rearward below the drum 30 and is bent upward to communicate with the suction holes 34. At an inlet of the suction duct 35 is provided a hot air heater 36 to heat air suctioned from the interior of the housing 20.

In an embodiment, the clothing dryer having the mist generator was described as being an exhaust-type dryer. However, embodiments may be applied to a condensation-type clothing dryer having a mist generator and a washing machine having a mist generator since they have the same control algorithm to remove wrinkles from clothing.

Figure 2:
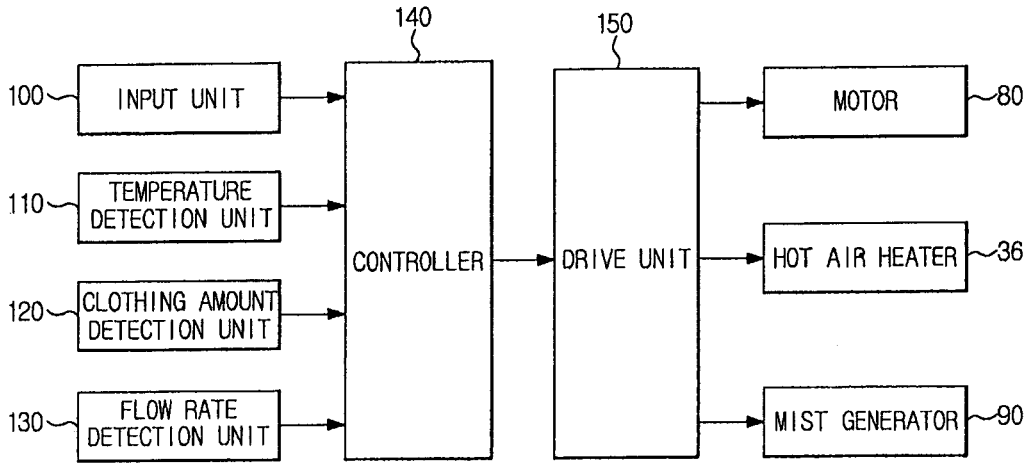
FIG. 2 is a function block diagram of the clothing dryer according to at least one embodiment.
Figure 3:
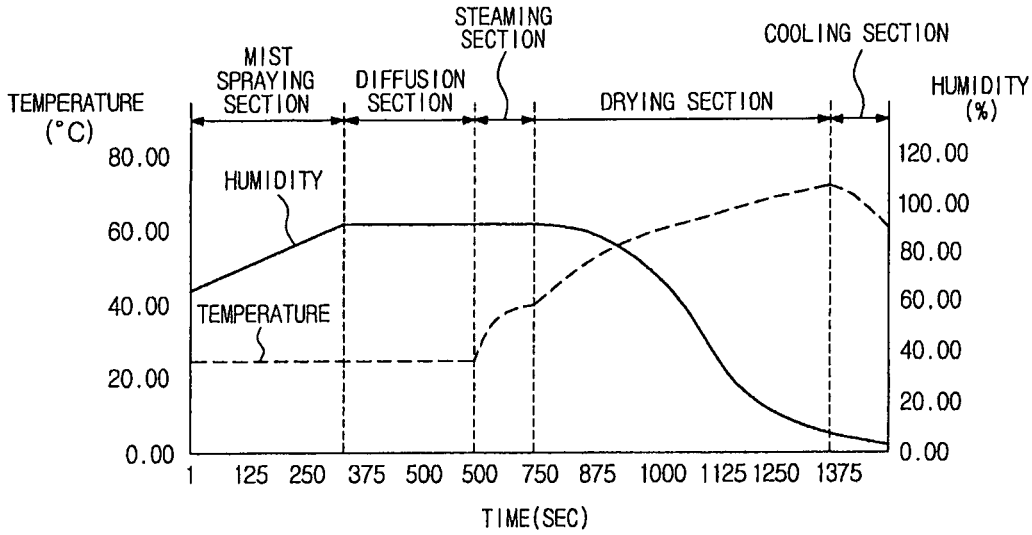
FIG. 3 is a graph illustrating a relationship between temperature and humidity in a drum during wrinkle removal performed by the clothing dryer according to at least one embodiment.

FIG. 2 is a function block diagram of the clothing dryer according to at least one embodiment, and FIG. 3 is a graph illustrating a relationship between temperature and humidity in the drum during wrinkle removal performed by the clothing dryer according to at least one embodiment.

The clothing dryer 10 includes an input unit 100 to allow a user to directly input operation information, such as a drying course or a wrinkle removal course or kinds of clothing, a temperature detection unit 110 to detect an interior temperature of the drum 30 or a temperature of the suction duct 35, a clothing amount detection unit 120 to detect the amount of clothing in the drum 30, a flow rate detection unit 130 provided in the mist generator 90 to detect the flow rate of mist, a controller 140 to control overall operations of the clothing dryer 10 according to the operation information input from the input unit 100, and a drive unit 150 to drive the motor 80, the hot air heater 36 and the mist generator 90 according to a drive signal from the controller 140.

The input unit 100 allows the user to input operation information, such as a drying course or a wrinkle removal course. During the wrinkle removal from clothing, the input unit 100 allows the user to input kinds of the clothing.

The clothing amount detection unit 120 detects the amount of clothing in the drum 30. The amount of clothing may be detected using various well-known methods, such as a method of using a current value sensed based on torque generated during rotation of the motor 80 or a method of using a weight detection sensor.

The controller 140 controls overall operations of the clothing dryer 10 according to the operation information (for example, the drying course or the wrinkle removal course) input from the input unit 100.

When the wrinkle removal course is selected, the controller 140 receives information on the amount of clothing in the drum 30, and controls the amount of mist to be adjusted according to the amount of the clothing and the mist to be sprayed into the drum 30. In a mist spraying section, humidity in the drum 30 is increased, whereas temperature in the drum 30 is not changed.

When a small amount of mist is supplied into the drum 30 as compared with the amount of clothing in the drum 30, wrinkles may not be sufficiently removed from the clothing. On the other hand, when a large amount of mist is supplied into the drum 30 as compared with the amount of clothing in the drum 30, the clothing may not be sufficiently dried in a subsequent drying process. The controller 140 controls an appropriate amount of mist supplied to the clothing. Hereinafter, a method of the controller 140 controlling the amount of mist to be sprayed according to the amount of clothing will be described.

A designer calculates the difference in weight between clothing before and after spraying to confirm the weight of mist reaching the clothing (hereinafter, referred to as "the reaching amount of mist"), and confirms a wrinkle removal level of the clothing after the completion of a wrinkle removal course. The designer repeats the above experiment by changing the reaching amount of mist according to a predetermined amount of clothing. A detailed description will be given based on Table 1 below.

TABLE 1

| Clothing (Cotton: 150 g) | |
|---|---|
| Reaching amount of mist (~mist spraying time) | Wrinkle removal level |
| 15.5 g (~4 minutes) | 3.3 |
| 25.5 g (~6.6 minutes) | 3.5 |
| 40.5 g (~10.5 minutes) | 2.8 |

In Table 1, a wrinkle removal performance of 3.5 or higher out of 5.0 indicates a state in which wrinkles are removed from clothing such that the clothing may be worn without ironing. When the reaching amount of mist is 15.5 g, which indicates insufficiency in the reaching amount of mist, the wrinkle removal level is lowered, and, when the reaching amount of mist is 40.5 g, which indicates excess in the reaching amount of mist, the wrinkle removal level is lowered. Table 1 reveals that, when the reaching amount of mist is 25.5 g, the wrinkle removal level is relatively optimum. The designer may perform the above experiment to measure the optimum reaching amount of mist according to the amount of clothing, and, when the wrinkle removal is performed with the reaching amount of mist (150*17/100=25.5 g) equivalent to approximately twice standard regain of clothing (cotton: 8.5%), the wrinkle removal level is the highest.

Consequently, the controller 140 controls mist to be sprayed such that an amount of mist equivalent to twice standard regain of clothing reaches the clothing. Standard regain is the amount of moisture absorbed by a specific kind of clothing (for example, cotton) at a standard state (for example, temperature: 20° C.±2° C., humidity: 65%±2%) represented as a rate (weight of moisture absorbed in a standard state/weight of clothing*100). Table 2 reveals that standard regain may be changed based on kinds of fiber.

TABLE 2

| Fiber | Standard regain | Fiber | Standard regain |
|---|---|---|---|
| Cotton | 8.5 | Acryl | 1.3 to 2.5 |
| Flax | 12 | Nylon | 4 to 4.5 |
| Wool | 16 | Olefin | 0 to 0.1 |
| Silk | 11 | Polyester | 0.4 to 0.8 |
| Acetate | 6 | Glass | 0.0 to 0.3 |
| Rayon | 11.5 to 16 | Woolen goods | 16 |

Meanwhile, the controller 140 determines whether the kind of clothing has been manually input through the input unit 100. When it is determined that the kind of clothing has been manually input, the controller 140 recognizes the input kind of the clothing as the kind of clothing to which wrinkle removal is to be performed. When it is determined that the kind of clothing has not been input, the controller 140 recognizes the kind of clothing preset in the clothing dryer 10 as the kind of clothing. When the kind of clothing has been recognized, the controller 140 controls the amount of mist to be adjusted based on standard regain according to the recognized kind of clothing. For example, when the user sets the kind of clothing as cotton (standard regain: approximately 8.5%), the controller 140 receives information on the amount (weight) of clothing, and controls the amount of mist equivalent to approximately 17%, for example, (twice standard regain) of the clothing (cotton) to reach the clothing, during wrinkle removal.

For a clothing dryer 10 in which the blowing fan 73 and the drum 30 are simultaneously rotated by a single motor 80, when the motor 80 is driven to rotate the drum 30, the blowing fan 73 is simultaneously operated, during wrinkle removal. When the drum 30 is rotated in a mist spraying process, the blowing fan 73 is also operated, with the result that mist sprayed into the drum 30 is discharged out of the drum 30, and therefore, a portion of the mist is lost. To supply an amount of mist equivalent to twice standard regain to the clothing, the amount of mist lost by the rotation of the blowing fan 73 during spraying of the mist may be further sprayed in addition to the amount of mist equivalent to twice standard regain of the clothing. The amount of mist lost by the rotation of the blowing fan 73 according to time during which mist is sprayed may be calculated by experiments and previously stored when designing the clothing dryer 10. For a clothing dryer in which the blowing fan and the drum are individually rotated by two motors, on the other hand, the blowing fan is not operated even when the drum is rotated during spraying of the mist. When the amount of mist equivalent to twice standard regain is sprayed into the drum, therefore, all the mist may reach the clothing. Meanwhile, the amount of mist attached to the inner wall of the drum may be measured according to mist spraying time, and mist may be further sprayed in proportion to the measured amount of the mist, so as to more precisely control the amount of mist.

The amount of mist sprayed into the drum 30 may be measured by the flow rate detection unit 130 provided in the mist generator 90. Also, the mist generator 90 has the amount of mist to be sprayed according to time, and therefore, mist spraying time may be controlled to adjust the amount of mist to be sprayed.

The controller 140 controls the drum 30 to be continuously rotated while an appropriate amount of mist is sprayed into the drum 30 according to the above method such that the mist is uniformly sprayed throughout the drum 30.

The control unit 140 provides a diffusion section such that, after mist is sprayed into the drum 30, the sprayed mist is diffused and uniformly permeates into the clothing. When the drum 30 is continuously rotated after the mist is sprayed to the clothing, the mist supplied into the drum 30 is discharged out of the drum 30 before naturally permeating into the clothing, with the result that the mist does not uniformly permeate into the clothing. In this embodiment, therefore, the controller 140 sets an off time to be longer than an on time per operation cycle of the drum 30 (for example, on time: 5 seconds, off time: 55 seconds) such that the drum 30 is intermittently rotated. In the diffusion section, temperature and humidity in the drum 30 are not changed.

After the diffusion section, the controller 140 provides a steaming section to heat the clothing at a fiber rearrangement temperature such that fiber rearrangement of the clothing is achieved in a wet state.

The fiber rearrangement temperature (glass transition temperature) is a temperature to rearrange fiber of the clothing, i.e., a temperature at which fiber molecules of the clothing start to actively move. The fiber rearrangement temperature is changed depending upon a moisture content degree of clothing. The more moisture clothing has, the lower the fiber rearrangement temperature. In the steaming section, considerable moisture is present, and therefore, the fiber rearrangement temperature may be approximately 30 to 40° C., which is lower than a normal fiber rearrangement temperature (which will be described later). The fiber rearrangement temperature may vary from 30 to 40° C., ±1-2° C.

To this end, the controller 140 controls the hot air heater 36 to be operated such that the mist, having permeated into the clothing, is changed into steam in the clothing by energy applied to the mist. The controller 140 controls the hot air heater 36 to be operated to adjust the interior temperature of the drum to approximately 30 to 40° C. such that the mist is changed into steam, and wrinkles are preliminarily removed from the clothing through fiber rearrangement thereof. During a process of steaming the mist, the controller 140 controls the drum 30 to be continuously rotated such that the mist, having permeated into the clothing, is changed into steam by energy applied to the mist. In the steaming section, the mist is not evaporated out of the clothing but is changed into steam in the clothing to assist fiber rearrangement of the clothing in a wet state. Consequently, moisture is not evaporated out of the clothing, and therefore, temperature in the drum 30 is increased while humidity in the drum 30 is not changed.

After the steaming section, the controller 140 controls hot air generated by the hot air heater 36 to be supplied into the drum 30 such that the clothing in a conditioned state (a moisture content state between a wet state and a dry state) is dried at a fiber rearrangement temperature. In this state, the fiber rearrangement temperature is approximately 60 to 70° C., ±1-2° C. (see FIG. 4, for example), which is higher than a fiber rearrangement temperature in the wet state.

The fiber rearrangement temperature will be described in detail with reference to FIG. 4.

Figure 4:
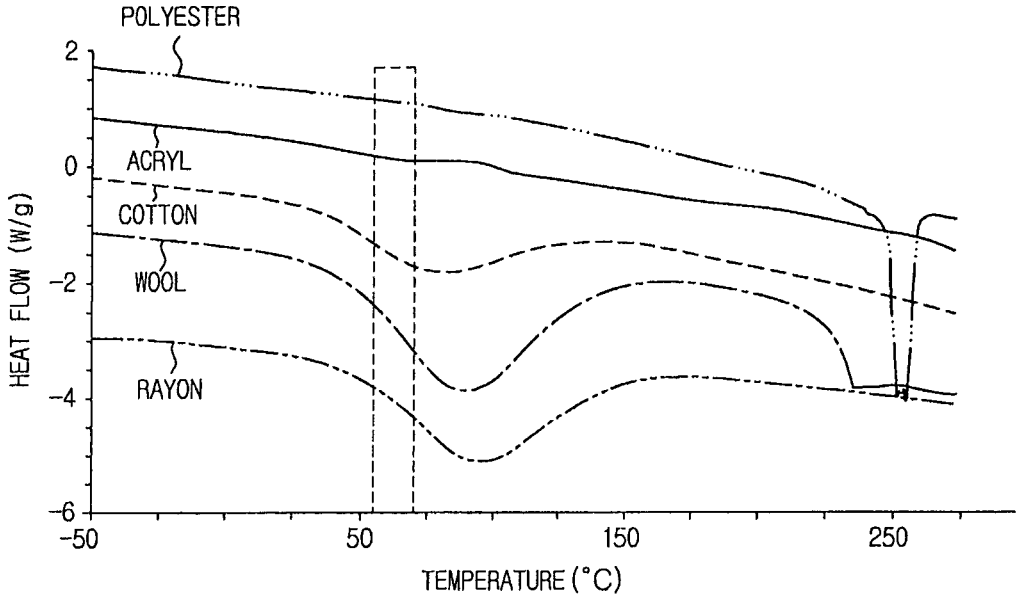
FIG. 4 is a graph illustrating endothermic curves of clothing to explain a fiber rearrangement temperature according to at least one embodiment.

FIG. 4 is a graph illustrating endothermic curves of clothing to explain the fiber rearrangement temperature, i.e., a graph illustrating energy loss of a dynamic mechanical analyzer based on temperature. The dynamic mechanical analyzer is an apparatus to measure energy loss based on temperature. The dynamic mechanical analyzer loses energy in proportion to heat absorbed by clothing. Clothing evaporates moisture in proportion to increased temperature, and absorbs ambient temperature in proportion to evaporated moisture. At this time, temperature at which an endothermic curve starts to be changed is 60 to 70° C. on the average, although the temperature may be different depending upon the kind of clothing. That is, since the temperature at which fiber of the clothing starts to be rearranged is 60 to 70° C. on the average, this arrangement temperature may be maintained in a drying section of the clothing such that fiber rearrangement is accelerated and additional wrinkles are not generated.

Consequently, the controller 140 controls the fiber rearrangement temperature to be 60 to 70° C., which is an average temperature at which fiber of clothing is rearranged, in the drying section during wrinkle removal such that the clothing is dried. Also, the controller 140 controls the drum 30 to be continuously rotated during a drying time to accelerate the drying of the clothing. In the drying section, the temperature in the drum 30 is increased, and the humidity in the drum 30 is decreased.

The clothing preliminarily fiber-rearranged in the steaming section is secondarily dried at 60 to 70° C., which is the fiber rearrangement temperature, in the drying section, such that the clothing is fiber-rearranged, and therefore, wrinkles are sufficiently removed from the clothing.

The controller 140 controls the clothing, the temperature of which has been increased through the supply of hot air, to be cooled. The cooling is performed for a predetermined time. During the cooling time, the controller 140 controls the drum 30 to be rotated such that the clothing is uniformly cooled. The controller 140 may control the cooling time based on the amount of the clothing. Since cooling is not affected by the amount of clothing, the cooling may be performed based on a predetermined time. The controller 140 may control cold air to be supplied into the drum 30 or clothing to be left as it is for a predetermined time such that cooling is performed. In a cooling section, the temperature in the drum 30 is decreased, and the humidity in the drum 30 is hardly changed.

Figure 5:
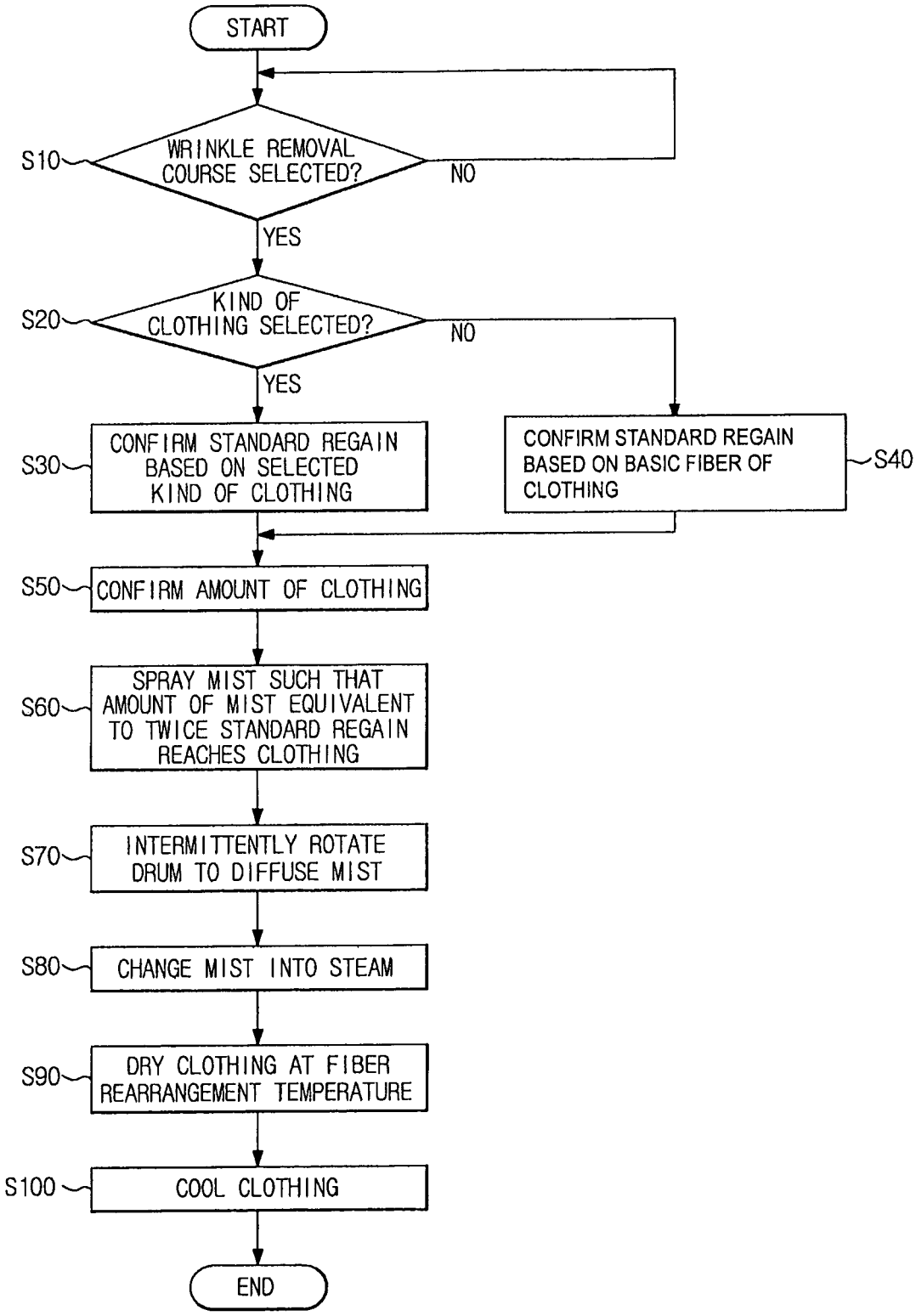
FIG. 5 is a control flow chart of the clothing dryer according to at least one embodiment.

FIG. 5 is a control flow chart of the clothing dryer according to at least one embodiment.

As shown in FIG. 5, the controller 140 determines whether a wrinkle removal course of the clothing dryer 10 has been selected through the input unit 100 (S10).

When it is determined that the wrinkle removal course of the clothing dryer 10 has been selected, the controller 140 determines whether the kind of clothing has been manually input through the input unit 100 (S20).

When it is determined that the kind of clothing has been manually input, the controller 140 confirms standard regain based on the input kind of clothing, and, when it is determined that the kind of clothing has not been input, the controller 140 confirms standard regain based on the kind of clothing set based on the basic kind of fiber of the clothing in the clothing dryer 10 (S30 and S40).

Subsequently, the clothing amount detection unit 120 detects the amount of the clothing in the drum 30 and transmits the detected information to the controller 140. The amount of clothing may be detected using various well-known methods, such as a method of using a current value sensed based on torque generated during rotation of the motor 80 or a method of using a weight detection sensor (S50).

The controller 140 controls a supply of an amount of mist equivalent to twice standard regain of the clothing to be sprayed such that the mist reaches the clothing. Standard regain is the amount of moisture absorbed by a specific kind of clothing (for example, cotton) at a standard state (for example, temperature: 20° C.±2° C., humidity: 65%±2%) represented as a rate (weight of moisture absorbed in a standard state/weight of clothing*100) (S60).

After the mist is supplied, the controller 140 controls the drum 30 to be intermittently rotated such that the sprayed mist is uniformly diffused to the clothing. The controller 140 sets an off time to be longer than an on time per operation cycle of the drum 30 (for example, on time: 5 seconds, off time: 55 seconds), and then controls the drum 30 to be rotated according to the on time and the off time (S70).

Subsequently, the controller 140 controls the hot air heater 36 to be operated to adjust the interior temperature of the drum to approximately 30 to 40° C. such that the mist in the clothing is changed into steam, and the clothing is preliminarily fiber-rearranged. During a process of steaming the mist, the controller 140 controls the drum 30 to be continuously rotated such that the mist, having diffused to the clothing, is uniformly changed into steam (S80).

The controller 140 controls the hot air, generated by the hot air heater 36, to be supplied into the drum 30 such that the clothing, having been preliminarily fiber-rearranged in a wet state, is dried at a fiber rearrangement temperature (glass transition temperature). The controller 140 controls the drum 30 to be continuously rotated even in the drying section to accelerate the drying of the clothing (S90).

The controller 140 controls the clothing, the temperature of which has been increased through the supply of hot air, to be cooled. The cooling is performed for a predetermined time. During the cooling time, the controller 140 controls the drum 30 to be rotated such that the clothing is uniformly cooled. The controller 140 may control cold air to be supplied into the drum 30 or may leave the clothing as it is for a predetermined time such that cooling is performed (S100).

In accordance of one aspect of at least one embodiment, an appropriate amount of mist is sprayed according to the kind of clothing to remove wrinkles from the clothing, thereby improving wrinkle removal performance.

In accordance of another aspect of at least one embodiment, mist sprayed to clothing is diffused and changed into steam to remove wrinkles from the clothing, thereby improving wrinkle removal performance.

Although at least one embodiment has been shown and described, it would be appreciated by those skilled in the art that changes may be made in these embodiments without departing from the principles and spirit of the invention, the scope of which is defined in the claims and their equivalents.

What is claimed is:

1. A control method of a clothing dryer to spray mist into a drum of the clothing dryer to remove wrinkles from clothing within the drum, the control method comprising:

detecting an amount of the clothing within the drum;

determining twice standard regain per unit weight of the clothing based on at least the detected amount of the clothing;

spraying mist such that an amount of mist equivalent to approximately twice standard regain per unit weight of the clothing reaches the clothing;

diffusing the mist to the clothing by intermittently rotating the drum, after spraying the mist to the clothing;

steaming the mist at an inside the clothing, and by operating a hot air heater to raise an interior temperature of the drum, after diffusing the mist to the clothing; and drying the clothing at a fiber rearrangement temperature to remove wrinkles from the clothing, wherein the spraying of mist is performed before supplying hot air into the drum.

2. The control method according to claim 1, wherein the standard regain of the clothing is determined based on a kind of the clothing.

3. The control method according to claim 2, wherein the kind of the clothing is manually input by a user.

4. The control method according to claim 1, wherein the spraying the amount of mist comprises calculating the amount of mist to be sprayed based on the detected amount of the clothing and the standard regain of the clothing.

5. The control method according to claim 1, wherein the fiber rearrangement temperature is between approximately 60 and 70° C.

6. The control method according to claim 1, wherein intermittently rotating the drum comprises setting an off time to be longer than an on time per operation cycle of the drum and intermittently rotating the drum according to the off time and the on time per operation cycle.

7. The control method according to claim 1, further comprising supplying hot air into the drum, such that the mist in the clothing is changed into steam, before drying the clothing.

8. The control method according to claim 7, wherein during steaming, the hot air is supplied such that the temperature in the drum reaches approximately 30 to 40° C.

9. The control method according to claim 1, wherein the intermittently rotating the drum, the drum is rotated while having OFF time set to be longer than ON time during each operation cycle of the drum.

10. A control method of a clothing dryer to spray mist into a drum of the clothing dryer to remove wrinkles from clothing within the drum, the control method comprising:

detecting an amount of the clothing within the drum;

spraying an amount of mist according to the detected amount of the clothing wherein the sprayed amount is approximately twice standard regain based on the detected amount of the clothing;

diffusing the mist to the clothing by intermittently rotating the drum, after spraying the mist to the clothing;

steaming the mist at an inside the clothing, and by operating a hot air heater to raise an interior temperature of the drum, after diffusing the mist to the clothing; and drying the clothing wetted by the mist, wherein the spraying of mist is performed before supplying hot air into the drum.

11. The control method according to claim 10, wherein diffusing the mist to the clothing comprises setting an off time to be longer than an on time per operation cycle of the drum and intermittently rotating the drum according to the off time and the on time per operation cycle.

12. The control method according to claim 10, wherein drying the clothing wetted by the mist comprises drying the clothing at a fiber rearrangement temperature.

13. The control method according to claim 12, wherein the fiber rearrangement temperature is approximately 60 to 70° C.

14. The control method according to claim 10, further comprising changing moisture in the clothing into steam before drying the clothing wetted by the mist.

15. The control method according to claim 14, wherein changing moisture in the clothing into steam comprises changing the mist in the clothing into steam while maintaining the temperature in the drum at approximately 30 to 40° C.

16. The control method according to claim 10, further comprising supplying cold air into the drum, or leaving the clothing as it is for a predetermined time, to cool the clothing.

* * * * *